US006471798B1

(12) United States Patent
Oishi et al.

(10) Patent No.: US 6,471,798 B1
(45) Date of Patent: Oct. 29, 2002

(54) METHOD AND APPARATUS FOR HEAT TREATING STEEL

(75) Inventors: Yukihiro Oishi, Itami (JP); Nozomu Kawabe, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/786,430

(22) PCT Filed: Sep. 13, 1999

(86) PCT No.: PCT/JP99/04996

§ 371 (c)(1),
(2), (4) Date: Mar. 6, 2001

(87) PCT Pub. No.: WO00/17405

PCT Pub. Date: Mar. 30, 2000

(30) Foreign Application Priority Data

| | | |
|---|---|---|
| Sep. 18, 1998 | (JP) | 10-264135 |
| Jan. 20, 1999 | (JP) | 11-011847 |
| Jan. 20, 1999 | (JP) | 11-011849 |
| Jul. 13, 1999 | (JP) | 11-199521 |
| Sep. 7, 1999 | (JP) | 11-253242 |

(51) Int. Cl.[7] ..... C21D 9/52; C21D 9/573

(52) U.S. Cl. ..... 148/595; 148/598; 148/660; 148/638; 266/259

(58) Field of Search ..... 266/259, 260; 148/662, 660, 636, 637, 638, 595–599

(56) References Cited

FOREIGN PATENT DOCUMENTS

| | | |
|---|---|---|
| JP | 3-64421 | 3/1991 |
| JP | 58-39727 | 3/1993 |
| JP | 6-229681 | 8/1994 |

OTHER PUBLICATIONS

International Search Report.

Notification of Transmittal of Copies of Translation of the International Preliminary Examination Report.

Translation of PCT International Preliminary Examination Report.

*Primary Examiner*—Deborah Yee
(74) *Attorney, Agent, or Firm*—McDermott, Will & Emery

(57) ABSTRACT

A method for heat-treating steel, which method uses a coolant having a large coefficient of heat transfer and which method treats the steel at low cost and in an environment-friendly manner (no pollution), and an apparatus for the method. The heat-treatment method cools austenitized steel in a coolant, which is a mixture of solid particles and water. It is desirable to cool the steel by passing it through a deposited layer of the solid particles in the water. It is desirable that the solid particles be oxides or graphite powders. It is also desirable to fluidize the solid particles. One type of the heat-treatment apparatus submerges steel in a coolant bath described below. The coolant bath comprises (a) a liquid bath that contains water and (b) a solid-particle bath that is partitioned in the liquid bath by a mesh and that contains solid particles. The mesh has openings smaller than the particle diameter of the solid particles. Another type of the heat-treatment apparatus treats steel by using a loaded coolant comprising water and solid particles and a means for forcibly supplying water between the solid particles. It is desirable that this type be provided with a means for fluidizing the solid particles.

13 Claims, 7 Drawing Sheets

METHOD AND APPARATUS FOR HEAT TREATING STEEL

TECHNICAL FIELD

The present invention relates to a method for heat-treating steel at low cost in order to impart sufficient strength to the steel and also relates to an apparatus for such a heat treatment.

BACKGROUND ART

It is known that the types of patenting treatments include lead patenting, molten-salt patenting, fluidized-bed patenting, air patenting, and mist patenting. Off-line patenting treatments mainly employ a lead bed and a fluidized bed. Immediate heat treatments after rolling employ a molten salt, air, and mist.

Lead and a molten salt have a large coefficient of heat transfer, enabling steel to cool rapidly. This is advantageous in obtaining a steel product having high strength. Therefore, they are most effective coolants for obtaining high quality. However, they are not only costly but also produce noxious fumes and toxic substances such as lead oxide because they are used in a lead-bath furnace and a molten-salt furnace. As a result, they are not desirable with respect to the prevention of environmental pollution.

When air and mist are used as a coolant, although they are free from environmental problems, they have a small coefficient of heat transfer and are unable to cool steel rapidly. Therefore, they require to add into the steel material an element that retards the pearlitic transformation in order to obtain a high-strength product. They have another problem in that the product obtained by their use is inferior in strength to a product obtained through lead patenting.

The heat treatment using a fluidized-bed also has a problem of a small coefficient of heat transfer. In the case of wires, this heat-treatment method cannot be applied with sufficient reliability to a wire having a diameter as thick as 2.0 mm or more because sufficient strength may not be obtained.

As described above, in both off-line patenting treatments and immediate heat treatments after rolling, no coolant is known that concurrently satisfies the foregoing three requirements: a large coefficient of heat transfer that enables a steel product to acquire high strength and low cost production, and cause no environmental pollution.

Consequently, the main object of the present invention is to offer a method for heat-treating steel by using a coolant having a large coefficient of heat transfer, at low cost, and which is environment-friendly and to offer an apparatus for such a heat treatment.

DISCLOSURE OF THE INVENTION

The present invention accomplishes the foregoing object by cooling steel in a mixture of solid particles and water.

The mixture may be in a state of suspension in which the solid particles are dispersed in the water. Nevertheless, it is desirable to deposit the solid particles in the water in order to cool the steel in the deposited layer. This method increases the cooling rate, making the cooling more effective.

It is desirable that the solid particles be refractory materials that have high thermal conductivity and that do not deteriorate even in contact with steel at about 900 to 1,000° C. Of the refractory materials, oxides are particularly suitable. More specifically, it is desirable to use at least one oxide selected from the group consisting of $Al_2O_3$, CaO, MgO, $SiO_2$, $ZrO_2$, $ZrO_2$. $SiO_2$, $B_2O_3$, FeO, $FeO_2$, and $Fe_2O_3$. In particular, the mixing of iron oxide (FeO, $FeO_2$, or $Fe_2O_3$) is effective in preventing the deterioration of the coolant during a prolonged heat treatment. Particles other than the foregoing iron oxide-family sand, such as metal particles and alloy particles, can be used effectively as the solid particles. However, in consideration of a long-term continuous operation, it is desirable to use oxide-family sand considering its resistance to deterioration and corrosion. Graphite powders may also be used as the solid particles. Graphite powders have small specific gravity and high thermal conductivity. Therefore, they are particularly suitable as a coolant for a steel wire disposed on a moving conveyor by a circling laying head for forming a coiling configuration. In the case of substances that tend to coagulate, such as graphite powders, it is desirable to add a surface-active agent to prevent the coagulation.

It is desirable that the solid particles have a specific gravity of 1.0 or more. If the specific gravity is less than 1.0, the solid particles float in the water, making it difficult for the steel to pass through the collection of particles. It is desirable that the specific gravity be 5.0 or less. If more than 5.0, it becomes difficult to insert and carry the steel through the collection of solid particles. In particular, when a heat treatment is carried out for a steel wire disposed on a moving conveyor by a circling laying head for forming a coiling configuration, it becomes difficult to insert and carry the steel wire through the collection of solid particles. It is more desirable that the solid particles have a specific gravity of 3.0 or less. Even a refractory material having a large specific gravity may be used as the solid particles by obtaining a hollow structure in order to reduce the weight per unit volume.

It is desirable that 80 wt % or more of the solid particles have a particle diameter of 1.0 mm or less. If the particle diameter exceeds 1.0 mm, the interstices in which the water can be in direct contact with the steel increases. This increase may cause the nucleate boiling of the water, further enhancing the cooling effect. As a result, an undesirable martensite structure may be formed. In particular, it is desirable that the solid particles have an average particle diameter of 150 $\mu$m or less. The average particle diameter of 150 $\mu$m or less facilitates the insertion and carrying of the steel even with solid particles having a specific gravity close to 5.0. It is more desirable that the average particle diameter be 100 $\mu$m or less.

When the amount of water in the vicinity of the steel is insufficient, the cooling rate of the steel decreases, thereby increasing variations in the strength of the steel in the longitudinal direction. This water deficiency can be prevented by any of the following arrangements:

① The use of a heat-treatment apparatus comprising (a) a liquid bath that contains water and (b) a solid-particle bath that is partitioned in the liquid bath by a mesh and that contains solid particles. The mesh has openings smaller than the particle diameter of the solid particles. The steel is inserted into the mixture of the solid particles and water in the solid-partide bath so that the steel is cooled.

② The limitation of the insertion depth of the steel into the mixture of the solid particles and water to 40 cm or less.

③ The forced supply of water between the solid particles in order to prevent the water deficiency between the solid particles in the vicinity of the steel.

In the arrangement ①, since the mesh has openings smaller than the particle diameter of the solid particles, no solid particles escape to the outside of the mesh. Consequently, whereas the solid-particle bath contains the mixture of the solid particles and water, the liquid bath contains water only. There is no specific limitation on the material of the mesh on condition that the mesh can retain the solid particles. It is desirable to use a material such as stainless steel. The dual structure of the heat-treatment apparatus by the use of the mesh enables the solid-particle bath to be surrounded by water at all times, thereby preventing water deficiency in the vicinity of the steel.

It is desirable to stir the water in the liquid bath. The types of the means to stir the water include the rotation of a rotor having a fin in the liquid bath and the formation of a water flow by a pump. The stirring of the water in the liquid bath promotes the penetration of the water into the solid-particle bath, thereby preventing water deficiency in the vicinity of the steel.

In the arrangement ②, it is more desirable that the steel be inserted into the mixture of the solid particles and water (i.e., into the collection of solid particles) at a depth of 25 cm or less, preferably 10 cm or less. The reason is that as the insertion depth increases, it becomes difficult to supply water to the vicinity of the steel in the solid-particle bath.

In the arrangement ③, the formation of a water flow between the solid particles prevents water deficiency in the vicinity of the steel. More specifically, it is desirable that pipe-shaped nozzles be provided in parallel connection at the lower portion of the mixture of the solid particles and water to supply water to the solid particles from the nozzles. Although incapable of fluidizing the solid particles, the supplied water forms a water flow between the solid particles to prevent the water deficiency in the vicinity of the steel.

Additionally, the foregoing water supply may not only form the water flow between the solid particles but also fluidize the solid particles themselves. In order to fluidize the solid particles, mesh-shaped nozzles having numerous small openings may be provided at the lower portion of the mixture of the solid particles and water to supply water from the nozzles. The methods for the fluidization include the supply of water, steam, or air. However, steam and air are not desirable because they form spaces between the solid particles. A stable heat treatment can be conducted only when the fluidization is carried out by the supply of water.

The term "water" in the coolant includes hot water. It is desirable that the hot water have a temperature of 50° C. or higher, more desirably 70° C. or higher, preferably 90° C. or higher. If lower than 50° C., a martensite structure may be formed. The water temperature of 90° C. or higher can minimize the variation of the water temperature caused by the temperature variation of the steel, so that the stable heat treatment can be performed.

The heat-treatment method of the present invention may be applied to steel after rolling either on an off-line basis or on an in-line basis in which the steel is immediately heat-treated after the rolling.

The types of the target materials of the heat-treatment method of the present invention include various types of steel. Of these types, carbon steel can be effectively treated. In particular, high-carbon steel is most effectively treated. The heat-treatment method can be applied to any shape including a plate and a wire. In particular, the method is applied to a wire most suitably.

The heat-treatment apparatus of the present invention is an apparatus for heat-treating steel by submerging the steel in a coolant bath. The coolant bath comprises (a) a liquid bath that contains water and (b) a solid-particle bath that is partitioned in the liquid bath by a mesh and that contains solid particles. The mesh has openings smaller than the particle diameter of the solid particles.

It is desirable that the liquid bath be provided with a means for stirring the water. It is also desirable to provide a means for forcibly supplying water between the solid particles. In particular, it is desirable to provide a means for fluidizing the solid particles by the supply of water.

SIMPLE EXPLANATION OF THE DRAWINGS

In the drawings:

FIG. 4(*b*) is a schematic diagram showing the heat-treatment apparatus of the present invention in which the zircon sand is contained in a mesh partition in water;

FIG. 4(*c*) is a schematic diagram showing the heat-treatment apparatus of the present invention in which the water in the liquid bath illustrated in the apparatus shown in FIG. 4(*b*) is stirred;

Figure 1:
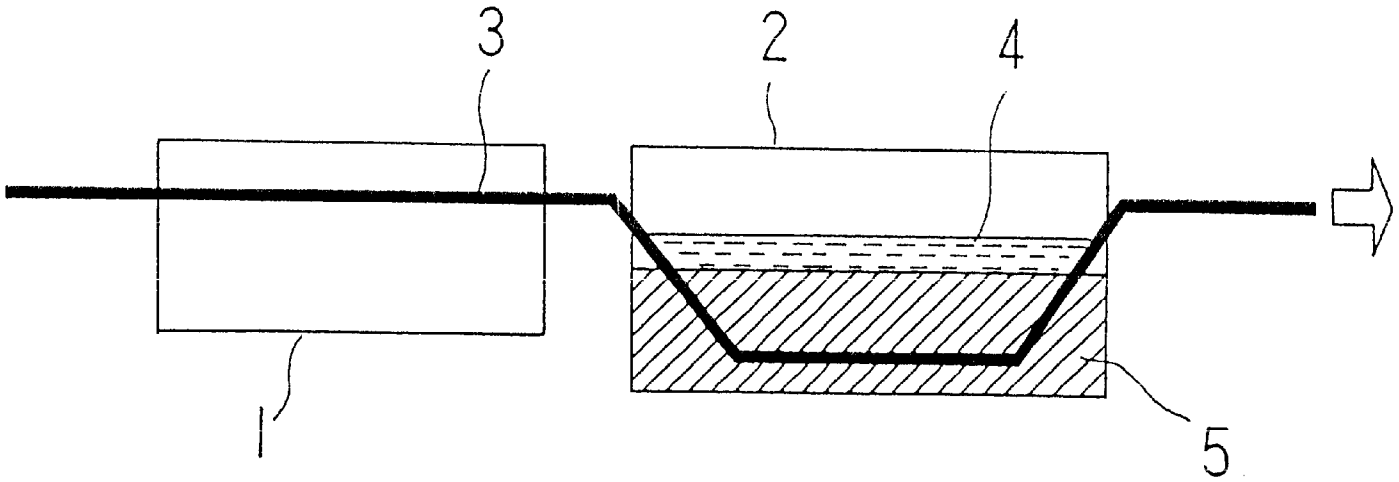
FIG. 1 is a view illustrating a heat-treatment method of the present invention.

The signs in the drawings are explained as follows:

1: Heating furnace; 2: Coolant bath; 3: Steel wire; 4: Water; 5: Solid particles; 11: Boiling water; 12: Solid particles; 13: Steel wire; 21: Zircon sand; 22: Water; 23: Mesh; 24: Solid-particle bath; 25: Liquid bath; 26: High-carbon steel wire; 27: Pipe; and 28: Small holes.

BEST MODE FOR CARRYING OUT THE INVENTION

The embodiments of the present invention are explained below.

TEST EXAMPLE 1

First, carbon-steel wires, 11.5 mm in diameter, containing 0.80 wt % C, 0.22 wt % Si, and 0.73 wt % Mn were heated.

Then, the wires were divided into two groups to be cooled under the following different conditions as off-line patenting treatments.

① As shown in FIG. 1, a coolant bath 2 was provided directly behind a heating furnace 1. A steel wire 3 heated in the heating furnace 1 was introduced into the coolant bath 2. The coolant bath 2 contained water 4 and solid particles 5. The solid particles 5 were maintained in the deposited state in the water. The steel wire 3 was heated in the heating furnace 1 at a temperature of 950° C. The water 4 hot water at 97° C. The heated steel wire 3 was introduced into the deposited layer of the solid particles to be cooled (Example 1-1). The solid particles consisted mainly of $ZrO_2$ (zirconia).

② A heated steel wire was cooled in lead at 540° C. (Comparative Example 1-1).

After the heat treatments, tensile tests were conducted to evaluate the tensile strength. The results showed that Example 1-1 cooled under Condition ① had a tensile strength of 1,222 N/mm$^2$ and Comparative Example 1-1 cooled under Condition ② also had the same tensile strength of 1,222 N/mm$^2$. This result demonstrates that the method of the present invention can yield a strength comparable to that obtained by patenting using lead.

TEST EXAMPLE 2

A steel material containing 0.80 wt % C, 0.22 wt % Si, and 0.73 wt % Mn was rolled to produce a wire having a diameter of 11.5 mm. The wire was immediately introduced into the same coolant bath as in Condition ① in fist Example 1 to carry out the in-line patenting. The tensile test result of the steel wire showed a strength of 1,225 N/mm$^2$. The strength is comparable to that obtained by the foregoing off-line patenting. This result demonstrates that the method of the present invention can also be applied to an immediate heat treatment after rolling.

TEST EXAMPLE 3

First, carbon-steel wires, 11.5 mm in diameter, containing 0.80 wt % C, 0.22 wt % Si, and 0.73 wt % Mn were heated. Then, the wires were divided into three groups to be cooled under the following different conditions as off-line patenting treatments. After the heat treatment, the steel wires were subjected to the measurement of tensile strength.

① As shown in FIG. 1, a coolant bath 2 was provided directly behind a heating furnace 1. A steel wire 3 heated in the heating furnace 1 was introduced into the coolant bath 2. The coolant bath 2 contained water 4 and solid particles 5 as a coolant. The solid particles 5 were maintained in a deposited state in the water. The steel wire 3 introduced into the coolant bath 2 passed through the deposited layer of solid particles to undergo the heat treatment (example 2-1).

② In FIG. 1, the solid particles were not deposited but dispersed in the water by stirring the water. The steel wire was introduced under this condition (Example 2-2).

③ A heated steel wire was cooled in lead at 540° C. (Comparative Example 2-1).

Under Conditions ① and ②, the following materials were individually used as the solid particles for each heat treatment: $Al_2O_3$, CaO, MgO, $SiO_2$, $ZrO_2$, $ZrO_2$. $SiO_2$, $B_2O_3$, and iron oxides (FeO, $FeO_2$, and $Fe_2O_3$). Every type of the solid particles has an average particle diameter of 0.2 mm. When the steel wire was introduced into the coolant bath; the wire had a temperature of 900° C. and the water temperature was 97° C. The velocity of the steel wire relative to the coolant was about 50 cm/sec. The test results of the tensile strength are shown in Table 1.

TABLE 1

| Solid particle | Conditions 1 (MPa) | Conditions 2 (MPa) | Conditions 3 (MPa) |
|---|---|---|---|
| $Al_2O_3$ | 1,241 | 1,229 | 1,222 |
| CaO | 1,238 | 1,225 | (By lead patenting; |
| MgO | 1,241 | 1,228 | no solid particles) |
| $SiO_2$ | 1,235 | 1,221 | |
| $ZrO_2$ | 1,245 | 1,232 | |
| $ZrO_2.SiO_2$ | 1,245 | 1,231 | |
| $B_2O_3$ | 1,230 | 1,215 | |
| FeO, $FeO_2$, and $Fe_2O_3$ | 1,244 | 1,232 | |

As can be seen from Table 1, Examples 2-1 and 2-2 both showed a strength comparable to that obtained by the lead patenting in Comparative Example 2-1. Any material for composing the solid particles used in the test was effective. Example 2-1, in which the solid particles were deposited in the water, was more effective in improving the strength than Example 2-2, in which the solid particles were dispersed in the water. This test result demonstrates that the method of the present invention can yield a strength comparable to that obtained by lead patenting.

TEST EXAMPLE 4

Several groups of solid particles having different particle diameters were individually deposited in water to carry out a heat treatment similar to that in Example 2-1. The object of the test was to examine the occurrence of nucleate boiling. All the solid particles used were composed of $ZrO_2$. $SiO_2$ (zircon). The test was conducted by changing the content of the solid particles ($ZrO_2$. $SiO_2$) that have a particle diameter exceeding 1 mm. The results are shown in Table 2.

TABLE 2

| Percentage of particles having a particle diameter exceeding 1 mm (wt %) | Nucleate-boiling initiating temperature (° C.) |
|---|---|
| 15 | No nucleate boiling |
| 19 | No nucleate boiling |
| 24 | 249 |
| 36 | 315 |
| 50 | 353 |
| 79 | 356 |
| 83 | 365 |

As can be seen from Table 2, when the content of the solid particles that had a particle diameter exceeding 1 mm was less than 20 wt %, no nucleate boiling occurred, suggesting that the obtained structure had a small rate of occurrence of martensite.

TEST EXAMPLE 5

Figure 2:
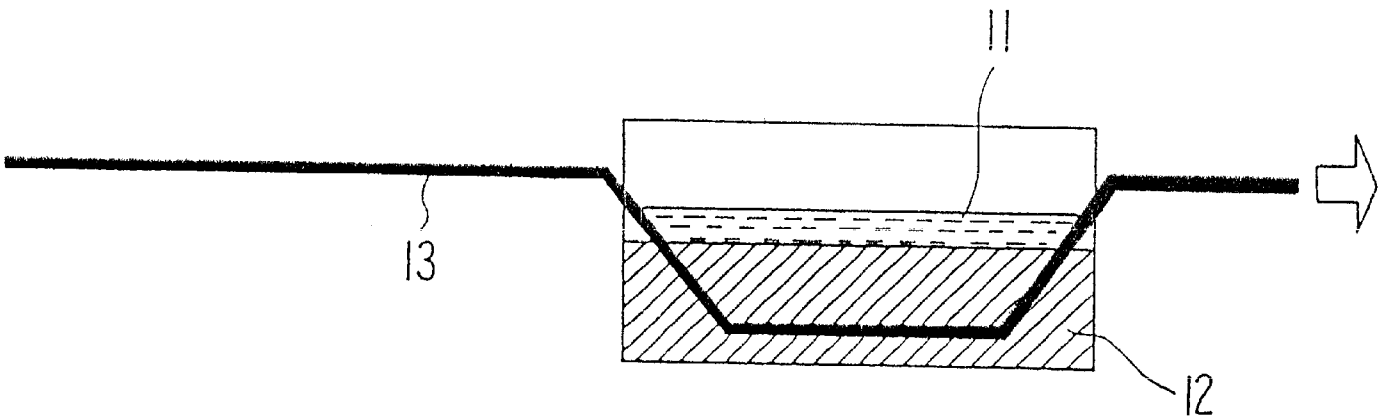
FIG. 2 is another view illustrating a heat-treatment method of the present invention.

A carbon-steel wire, 11.5 mm in diameter, containing 0.80 wt % C, 0.22 wt % Si, and 0.73 wt % Mn was disposed on a moving conveyor by a circling laying head for forming a coiling configuration having a diameter of about 1.2 m. The steel wire was introduced into a coolant bath to examine the insertability into the coolant and the tensile strength of the wire after the heat treatment. As shown in FIG. 2, the coolant was composed of solid particles 12 deposited in boiling water 11. Whether or not a steel wire 13 can be easily inserted into the deposited layer of solid particle was examined. Although illustrated as a straight line in FIG. 2, the steel wire 13 was disposed in a coiling configuration as described above. Three types of solid particles that had different values of specific gravity were used. The test was conducted by changing the average particle diameter for each type of the solid particles. The results are shown in Table 3, in which the sign "○" signifies that it was easy to insert the wire and the sign "X" signifies that it was difficult to do so.

TABLE 3

| Solid particle | Specific gravity | Particle diameter (PD) (μm) | Insertability of wire | Tensile strength (MPa) |
|---|---|---|---|---|
| $ZrO_2$ | 5.6 | PD ≦ 40 | X | — |
| | | 40 < PD ≦ 150 | X | — |
| | | 150 < PD ≦ 400 | X | — |
| | | 400 < PD ≦ 1000 | X | — |
| $Al_2O_3$ | 3.9 | PD ≦ 40 | ○ | 1,232 |
| | | 40 < PD ≦ 150 | ○ | 1,230 |
| | | 150 < PD ≦ 400 | X | — |
| | | 400 < PD ≦ 1000 | X | — |
| $SiO_2$ | 2.2 | PD ≦ 40 | ○ | 1,231 |
| | | 40 < PD ≦ 150 | ○ | 1,229 |
| | | 150 < PD ≦ 400 | ○ | 1,229 |
| | | 400 < PD ≦ 1000 | ○ | 1,228 |

As can be seen from Table 3, when $ZrO_2$, 5.6 in specific gravity, was used as the solid particles, it was not possible to insert the steel wire. When $Al_2O_3$, 3.9 in specific gravity, was used as the solid particles, it was possible to insert the steel wire only when the average particle diameter was 150 μm or less. When $SiO_2$, 2.2 in specific gravity, was used as the solid particles, it was easy to insert the steel wire without regard to the particle diameter. Therefore, it is desirable that the solid particles have a specific gravity of 5.0 or less and a particle diameter of 150 μm or less. The obtained tensile strength fell into the range of 1,228 to 1,232 MPa without regard to the solid particles used. In other words, the obtained results of the strength are comparable to or higher than 1,222 MPa obtained by the lead patenting of a wire having the same diameter.

TEST EXAMPLE 6

A steel wire, 11.5 mm in diameter, containing 0.82 wt % C was disposed on a moving conveyor by a circling laying head for forming a coiling configuration. The steel wire was heat-treated in coolants under different conditions, ① to ④, described below. The separately heat-treated steel wires were subjected to the measurement of tensile strength. Graphite powders, 2.2 in specific gravity, having an average particle diameter of 400 μm were used as the solid particles. When the steel wire was introduced into the coolant, the wire had a temperature of 900° C. and the water temperature was 97° C. The velocity of the steel wire relative to the coolant was about 50 cm/sec.

① The coolant was a stirred mixture of water and graphite powders. The steel wire was introduced into the coolant in which the graphite powders were dispersed in the water (Example 6-1).

② The graphite powders were deposited in the water. The steel wire was introduced into the deposited layer (Example 6-2).

③ The coolant was a mixture of water and graphite powders in which a surface active agent was added. The steel wire was introduced into the coolant in which the graphite powders were dispersed in the water without being deposited (example 6-3).

④ A heated steel wire was cooled in lead at 540° C. (Comparative Example 6-1).

The measured results of the tensile strength were 1,232 MPa for Condition ①, 1,242 MPa for Condition ②, 1,235 MPa for Condition ③, and 1,222 MPa for Condition ④. As shown above, Conditions ① to ③, methods of the present invention, showed better results than the result of Condition ④, a comparative example. The deposition of the graphite powders was more effective than the dispersion of the graphite powders. In Condition ③, the surface active agent was effective and no coagulation of the graphite powders was observed.

TEST EXAMPLE 7

Under Condition ② of Test Example 6 above, the percentage of the particles that had a particle diameter exceeding 1 mm in the graphite powders was changed to examine the occurrence of nucleate boiling during the heat treatment. The results are shown in Table 4.

TABLE 4

| Percentage of particles having a particle diameter exceeding 1 mm (wt %) | Nucleate-boiling initiating temperature (° C.) |
|---|---|
| 11 | No nucleate boiling |
| 18 | No nucleate boiling |
| 25 | 251 |
| 38 | 310 |
| 52 | 348 |
| 83 | 352 |
| 92 | 361 |

As can be seen from Table 4, when the percentage of the particles that had a particle diameter exceeding 1 mm was less than 20 wt %, no nucleate boiling occurred, suggesting that the obtained structure had a small rate of occurrence of martensite.

TEST EXAMPLE 8

Figure 3:
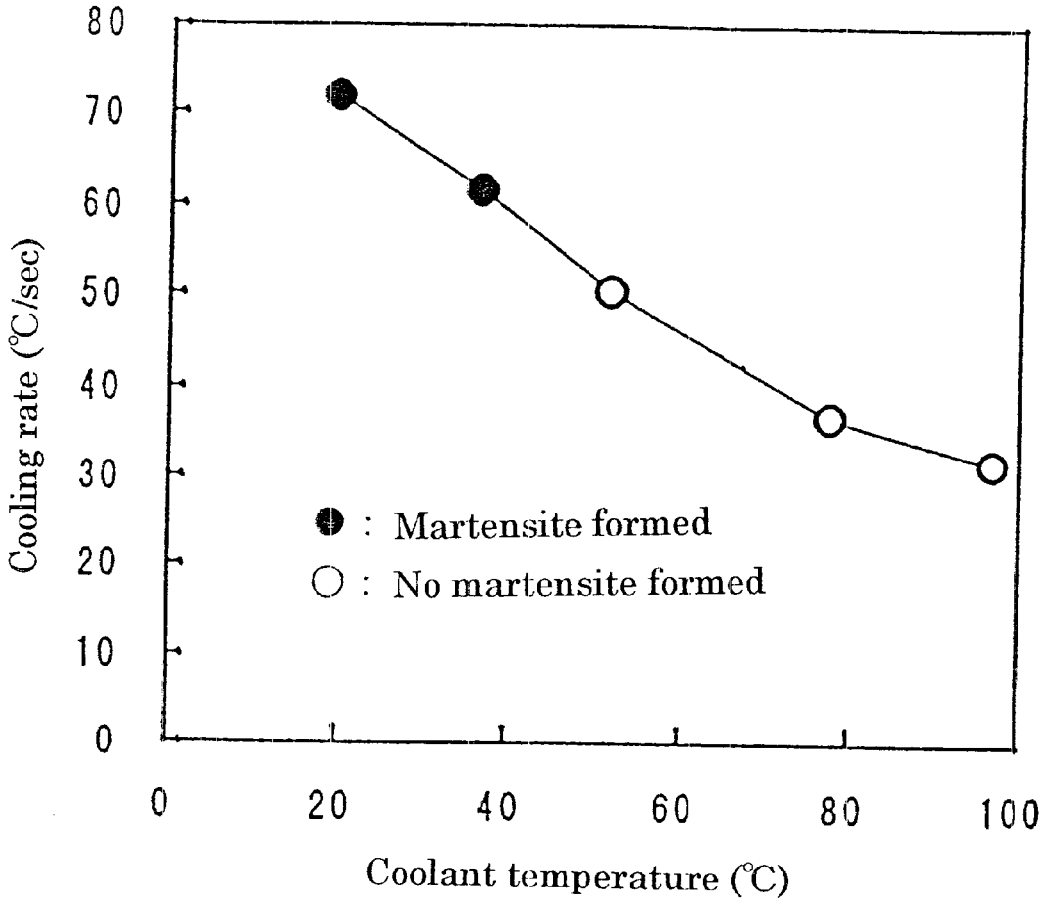
FIG. 3 is a graph showing the relationship between the cooling rate and the coolant temperature, indicating the presence or absence of the formation of martensite.

Under Condition ① of Test Example 6 above, the temperature of the mixture of water and graphite powders was changed to measure the cooling rate. When the steel ware was introduced into the coolant, the wire had a temperature of 900° C. The velocity of the steel wire relative to the coolant was about 50 cm/sec. The measured result is shown in the graph of FIG. 3. As can be seen from FIG. 3, when the coolant temperature was lower than 50° C., the cooling rate was high and the occurrence of martensite was observed. When the coolant temperature was 90° C. or higher, the cooling rate was stable.

TEST EXAMPLE 9

Hollow particles consisting mainly of $SiO_2$ and $Al_2O_3$ were dispersed in boiling water to be used as a coolant. (The hollow particles, 0.7 in specific gravity, are available in the market as a refractor.) As with Test Example 6, a steel wire was introduced into the coolant to be cooled. When the steel wire was introduced into the coolant, the wire had a temperature of 900° C. and the velocity of the steel wire relative to the coolant was about 50 cm/sec. The measured result of tensile strength after the heat treatment was as high as 1,221 MPa, comparable to the value obtained by lead patenting.

TEST EXAMPLE 10

Figure 4:
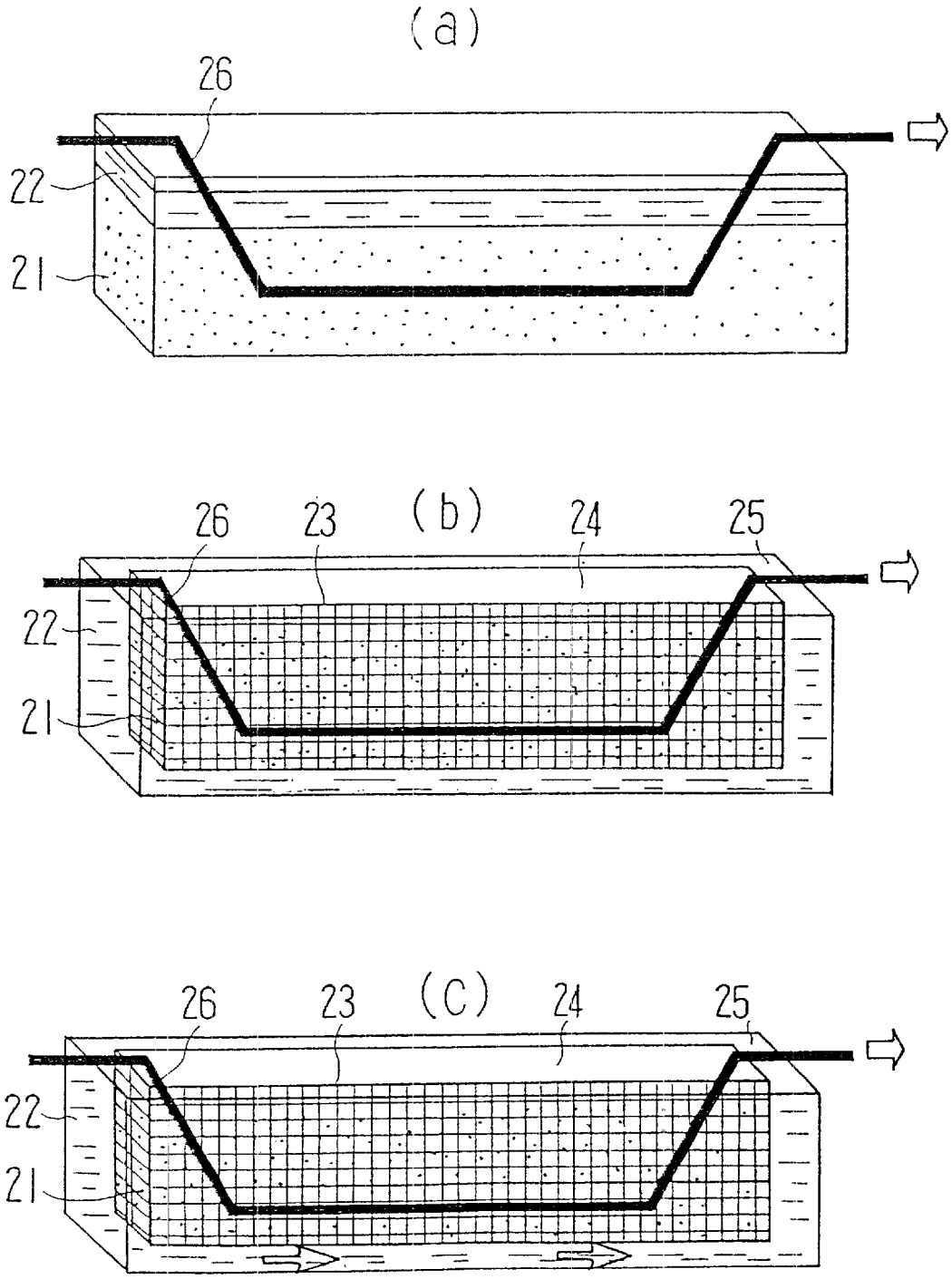
FIG. 4(*a*) is a schematic diagram showing a heat-treatment apparatus that uses a coolant composed of zircon sand and water.

FIG. 4 shows schematic diagrams of heat-treatment apparatus of the present invention. The apparatus shown if FIG.

4(*a*) has a heat-treatment bath in which zircon stand [1]21 ($Zr\ O_2.SiO_2$) having a particle diameter of 0.1 to 0.3 mm is deposited in water 22 at 97° C. The heat-treatment apparatus shown if FIGS. 4(*b*) and 4(*c*) are partitioned into an inner bath, a solid-particle bath 24, and an outer bath, a liquid bath 25, by a mesh 23 whose openings have a size of 0.09 mm. The solid-particle bath 24 contains zircon sand 21 ($Zr\ O_2.SiO_2$), 0.1 to 0.3 mm in particle diameter, deposited in water 22 at 97° C. The liquid bath 25 contains only water 22 to 97° C. No zircon sand is present in the liquid bath 25. The apparatus shown in FIG. 4(*c*) differs from the that shown if FIG.4(*b*) in that the water 22 outside the mesh 23 is stirred by a stirrer (not shown in the figure).

Figure 5:
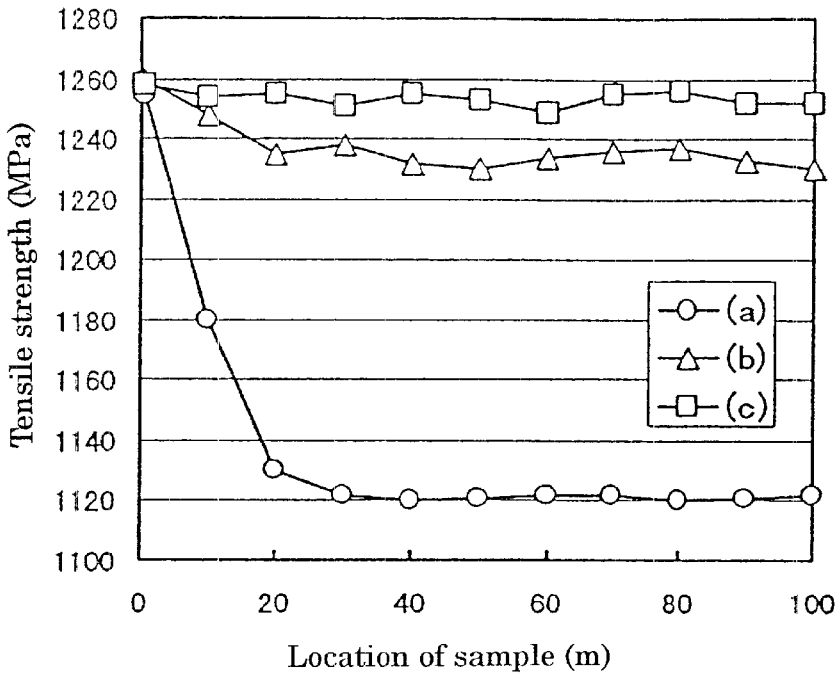
FIG. 5 is a graph showing the longitudinal distributions of the tensile strength of the steel wires heat-treated by the apparatus shown in FIGS. 4(*a*) to 4(*c*)

These three types of heat-treatment apparatus were used to carry out the patenting of a high-carbon steel wire 26 (C content: 0.82 wt %), 7.0 mm in diameter and heated at 950° C., by continuously passing it through the deposited layer of the zircon sand in the heat-treatment apparatus. The steel wire was inserted at a depth of about 50 cm from the top side of the zircon sand layer. The heat-treated wire was sampled at intervals of 10 m to measure the tensile strength. The results are shown in FIG. 5.

In the case of the steel wire treated by the apparatus shown in FIG. 4(*a*), a comparative example, although high strength can be obtained, the strength decreases with time. With the steel wire treated by the apparatus shown in FIG. 4(*b*), an example of the present invention, the decrease in the strength is reduced. Furthermore, with the steel wire treated by the apparatus shown in FIG. 4(*c*), another example of the present invention, the decrease in the strength is hardly recognized.

The foregoing results demonstrate that a high-strength steel wire can be stably obtained when a heat-treatment apparatus is partitioned into a solid-particle bath and a liquid bath by a mesh and when a steel wire is introduced into a mixture of solid particles and water. In particular, the stirring of the water outside the solid-particle bath can yield improved stability in strength. In this case, the water can be stirred by another method than a stirrer. The circulation of water by a pump and other methods for generating a water flow can yield a similar result.

TEST EXAMPLE 11

Figure 6:
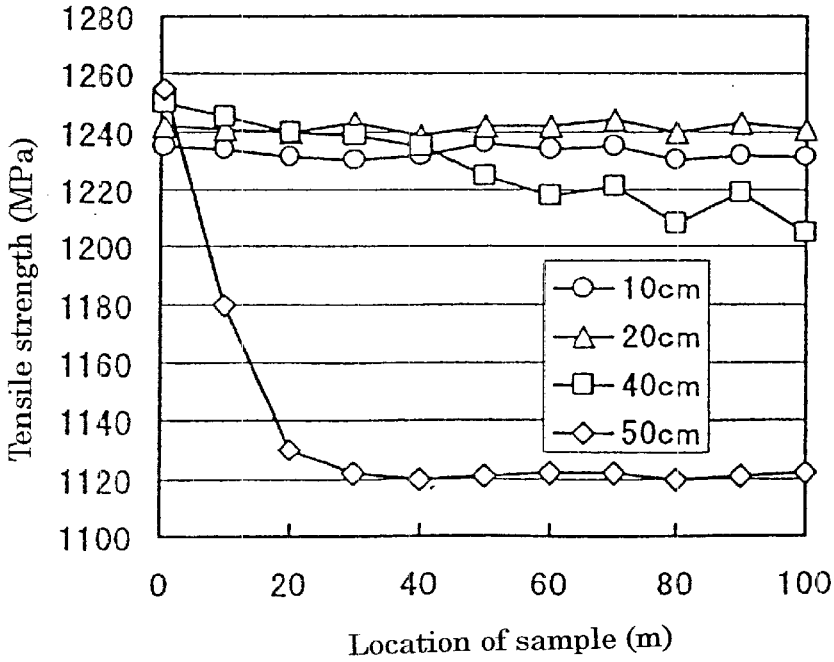
FIG. 6 is a graph showing the relationship between the longitudinal distribution of the tensile strength of a steel wire and the depth at which the steel wire was inserted in the mixture of zircon sand and water.

The heat-treatment apparatus shown in FIG. 4(*a*) was used for this test example. Heat treatments similar to Test Example 10 were carried out by changing the insertion depth of the steel wire into the zircon-sand layer as follows: 10, 20, 40, and 50 cm. The results are shown in FIG. 6. The decrease in strength with time observed at the depth of 50 cm was reduced as the depth decreased from 50 cm to 40 cm to 20 cm. Ultimately, an extremely stable strength was obtained at the depth of 10 cm.

TEST EXAMPLE 12

Figure 7:
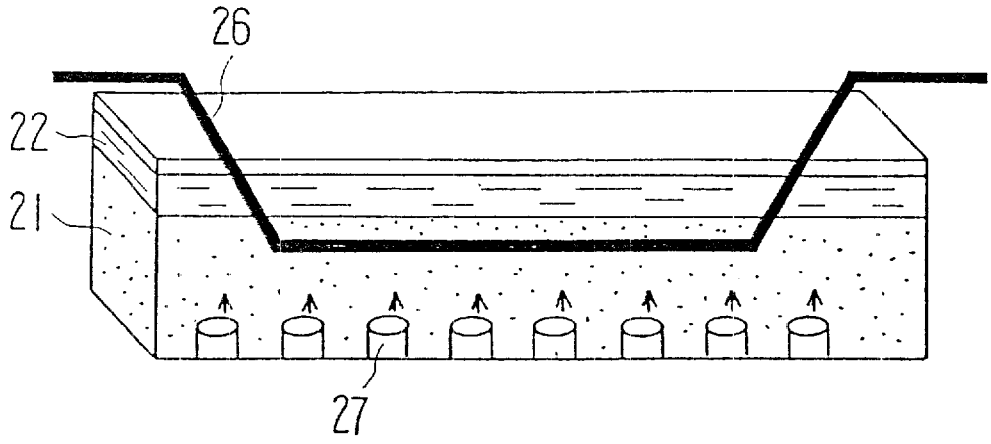
FIG. 7 is a schematic diagram showing the apparatus of the present invention that supplies water to the zircon sand.
Figure 8:
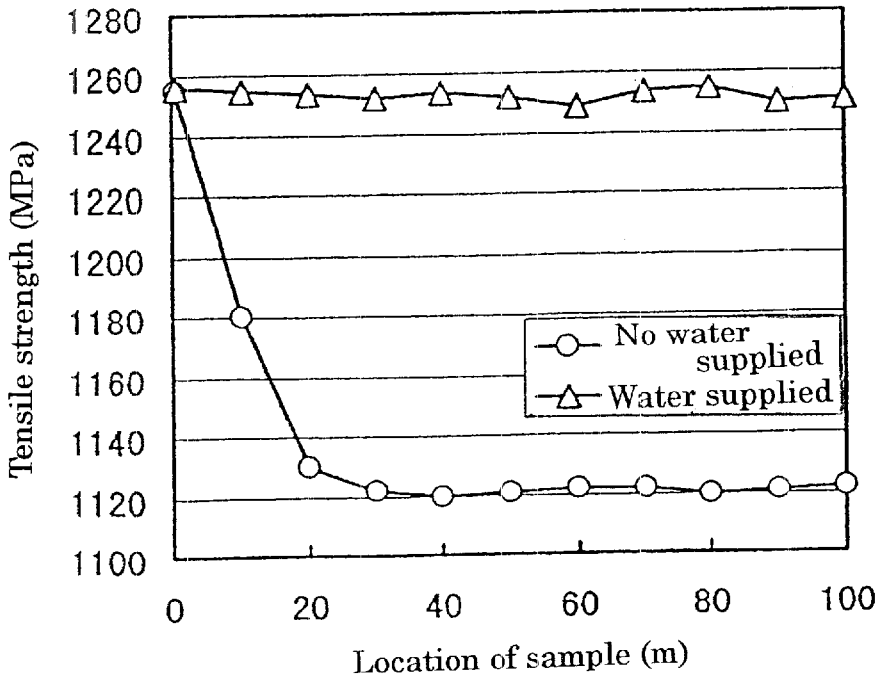
FIG. 8 is a graph showing the longitudinal distributions of the tensile strength of a steel wire when water was supplied to the zircon sand by means of the apparatus shown in FIG. 7 and when no water was supplied.

FIG. 7 is a schematic diagram showing a heat-treatment apparatus of the present invention. The apparatus has a heat-treatment bath in which zircon sand 1 is deposited in water 22. A plurality of pipes 27 in parallel connection are provided at the bottom of the heat-treatment bath. Water at 97° C. is continuously supplied to the zircon sand 21 from the pipes 27. Consequently, water is supplied forcibly between the zircon sand particles, forming a water flow between the particles. This heat-treatment bath was used to carry out a test similar to Test Example 10. As a comparative example, a similar heat treatment was carried out using an apparatus that has no water supply from the pipes 27. The strength of the steel wires after the heat treatment was measured. The results are shown in FIG. 8. As can be seen from FIG. 8, the method of the present invention can yield stable high strength.

TEST EXAMPLE 13

Figure 9:
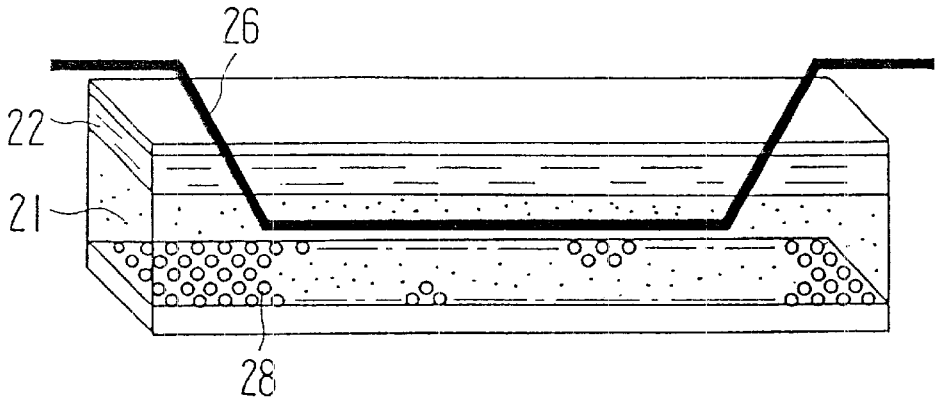
FIG. 9 is a schematic diagram showing the apparatus of the present invention that fluidizes the zircon sand.
Figure 10:
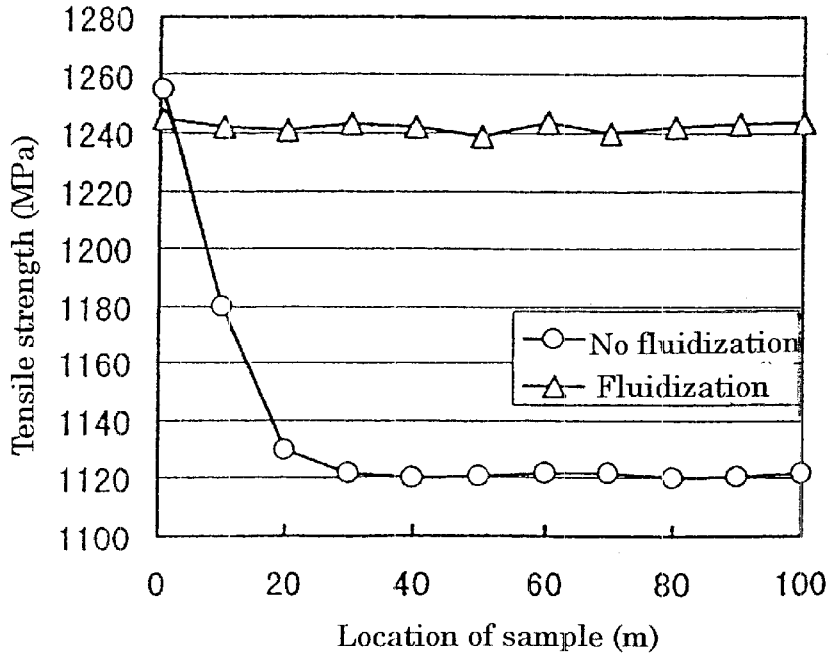
FIG. 10 is a graph showing the longitudinal distributions of the tensile strength of a steel wire when the zircon sand was fluidized by means of the apparatus shown in FIG. 9 and when no zircon sand was fluidized.

FIG. 9 is a schematic diagram showing a heat-treatment apparatus of the present invention. The apparatus has a heat-treatment bath in which zircon sand 21 is deposited in water 22. Numerous small holes 28 are uniformly provided at nearly the entire bottom portion of the heat-treatment bath. Jets of water from the small holes 28 flidize the zircon sand 21. This heat-treatment bath was used to carry out a test similar to Test Example 10. As a comparative example, a similar heat treatment was carried out using an apparatus in which no fluidization of the zircon sand 21 was performed. The strength of the steel wires after the heat treatment was measured The results are shown in FIG. 10. As can be seen from FIG. 10, the method of the present invention can yield stable high strength.

TEST EXAMPLE 14

A steel material containing 0.82 wt % C was hot-rolled to produce a wire having a diameter of 11.5 mm. The wire disposed on a moving conveyor by a circling laying head for forming a coiling configuration was immediately heat-treated under the following conditions: The coolant was a mixture of solid particles and water. The coolant had a temperature of 97° C. Four types of solid particles were used individually: zirconia ($ZrO_2$), zircon ($ZrO_2.\ SiO_2$), alumina ($Al_2O_3$), and silica ($SiO_2$). All types of the solid particles had an average particle diameter of about 200 $\mu$m. The solid particles were deposited in the water. The solid particles were. fluidized by the jets of water at 97° C. from the bottom of the coolant bath.

The wires were inserted into the coolant bath without difficulty irrespective of the types of the solid particles. The obtained strength, also without regard to the types of the solid particles, fell into the range of 1,230 to 1,250 MPa, comparable to the value obtained by lead patenting.

TEST EXAMPLE 15

Heat treatments similar to Test Example 14 were carried out by changing the coolant temperature as follows: 30, 50, 70, 80, 90, and 97° C. The coolant was fixed to the zircon sand. The results obtained are summarized below. In the case of 30° C., the obtained structure was martensite, without showing the formation of pearlite. With 50° C., although most of the obtained structure was pearlite, partly formed martensite structures were observed depending on the state of fluidization. Therefore, this temperature is not always suitable for a stable heat treatment. With 70, 80, 90, and 97° C., the obtained structure was entirely pearlite, enabling a stable heat treatment. The strength obtained in the case of the temperature of 70° C. or higher fell into the range of 1,230 to 1,250 MPa without showing a distinctive difference between temperatures.

INDUSTRIAL APPLICABILITY

As described above, the heat-treatment method of the present invention can offer a high-strength steel product at low cost and that causes no environmental pollution. The solid particles having a specific particle diameter can suppress the generation of nucleate boiling and the formation of martensite. In particular, the specified gravity of the solid particles or the fluidization of the solid particles in water enables easy insertion of a wire in coiling configuration into a coolant. The heat-treatment method of the present invention can be applied to an immediate heat treatment after rolling and to an off-line heat treatment and is effective in a patenting treatment of a wire.

The heat-treatment apparatus of the present invention uses a coolant having a large coefficient of heat transfer and can carry out low cost, environment-friendly (no pollution) heat treatment. In particular, even when a long steel wire is treated for a prolonged period of time, the apparatus can suppress the decrease in the strength of the wire after the heat treatment caused by the deficiency of water in the vicinity of the wire and by the rise in temperature of the sold particles. The apparatus can therefore produce a steel wire having stable strength.

What is claimed is:

1. A method for patenting steel by cooling austenitized steel in a coolant, wherein the coolant is a mixture of water at 50° C. or higher and solid particles in the water.

2. The method according to claim 1, the method comprising the steps of:

(a) depositing the solid particles in the water; and (b) passing the steel through the deposited layer of the solid particles to cool the steel.

3. The method according to claim 1, the method comprising the steps of:

(a) dispersing the solid particles in the water; and (b) passing the steel through the mixture of the solid particles and the water to cool the steel.

4. The method according to claim 1, wherein the solid particles are oxides.

5. The method according to claim 1, wherein the solid particles are graphite particles.

6. The method according to claim 1, wherein the object to be heat-treated is a carbon-steel wire.

7. The method according to claim 1, wherein:

(a) the object to be heat-treated is a steel wire after rolling; and (b) the heat treatment is carried out immediately after the rolling.

8. The method according to claim 1, wherein water is forcibly supplied between the solid particles to prevent the deficiency of water between the solid particles in the vicinity of the steel.

9. The method according to claim 8, wherein the solid particles are fluidized.

10. The method according to claim 9, wherein the solid particles are fluidized by the supply of water at the lower portion of the mixture of the solid particles and the water.

11. An apparatus for patenting steel by submerging the steel in a coolant bath, wherein:

(a) the coolant bath comprises:

(a1) a liquid bath that contains water; and (a2) a solid-particle bath that:

(a2a) is partitioned in the liquid bath by a mesh; and (a2b) contains solid particles; and (b) the mesh has openings smaller than the particle diameter of the solid particles.

12. An apparatus for patenting steel by using a loaded coolant comprising water at 50° C. or higher and solid particles in the water, the apparatus being provided with a means for forcibly supplying water between the solid particles.

13. The apparatus according to claim 12, the apparatus being provided with a means of fluidizing the solid particles.

* * * * *